US005899012A

United States Patent [19]

Crum

[11] Patent Number: 5,899,012

[45] Date of Patent: May 4, 1999

[54] FRAMED ARTWORK DISPLAY

[76] Inventor: Robert W. Crum, 3402 El Prado Blvd., Tampa, Fla. 33629

[21] Appl. No.: 08/422,933

[22] Filed: Apr. 17, 1995

[51] Int. Cl.[6] ..... G09F 13/00

[52] U.S. Cl. ..... 40/716

[58] Field of Search ..... 40/716, 737, 545, 40/715

[56] References Cited

U.S. PATENT DOCUMENTS

| | | | |
|---|---|---|---|
| 1,739,320 | 12/1929 | Lloyd | 40/715 |
| 1,746,578 | 2/1930 | Blum | 40/716 X |
| 1,802,170 | 4/1931 | Colbert et al. | 40/737 |
| 2,513,576 | 7/1950 | Luray | 40/716 X |
| 2,588,545 | 3/1952 | Lawrence | 40/716 |
| 2,623,314 | 12/1952 | Lombard | 40/716 X |
| 2,637,131 | 5/1953 | Paulson | 40/715 |
| 3,475,603 | 10/1969 | Gheno | 40/715 |
| 4,850,125 | 7/1989 | Green | 40/737 |
| 4,976,057 | 12/1990 | Bianchi | 40/545 X |

*Primary Examiner*—Joanne Silbermann
*Attorney, Agent, or Firm*—Charles A. McClure

[57] ABSTRACT

Laminar translucent artwork is displayed by back-lighting it substantially uniformly for viewing by transmitted light, bordering it with an opaque border, and decoratively framing it along the outside edge, and preferably also along the inside edge, of the border. Preferred display apparatus includes a shallow light-box containing a light source and flanged to provide the border, a light-diffusion sheet overlying the light-box and underlying the artwork, a transparent cover sheet for the artwork, overlain by the border(s).

15 Claims, 3 Drawing Sheets

FRAMED ARTWORK DISPLAY

TECHNICAL FIELD

This invention relates to framed display of artwork, especially via backlighting of translucent artwork and with multiple framing.

BACKGROUND OF THE INVENTION

Display of framed artworks ranges from illumination by natural reflected light, as in a modern gallery or museum, to conventional nearby incandescent or fluorescent lighting directed onto the surface of the artwork visible to a viewer, sometimes via slightly noticeable recessed or similarly supported external lighting means. Most such artworks are opaque to incident light, planar in arrangement, and are viewed from vantage points substantially perpendicular to an exposed surface plane—notwithstanding that some artworks are three-dimensional, or that an occasional artwork may be luminescent, as in Beck U.S. Pat. No. 5,149,568, and not require any lighting source.

Display signs presenting opaque words and/or pictures outlined by light transmitted from an adjacent light-box are well known, and in some instances such signs may be translucent so as to show color of letters or pictorial detail but are not viewed as works of art. Examples are presented in U.S. Pat. Nos., such as in illuminated signs by Gandy in 4,380,880 and Frois et al. in 4,559,731; and especially in neon signs by Bianchi in 4,976,057 and Kile in 5,270,910.

Translucent artworks illuminable by transmitted light are rarer than mere signs, and their display demands features not previously combined—or not done to best advantage. The present invention is directed to displaying such framed artworks as being itself useful.

SUMMARY OF THE INVENTION

A principal object of the present invention is to provide an optimal combination of means for displaying translucent artworks.

Another object of this invention is to display such artworks in manner analogous to display of framed artworks, with added framing.

A further object of the invention is to provide displays of back-lighted translucent artworks capable of hanging about as close to a wall as usual for an opaque artwork viewed by incident light.

Yet another object of this invention is to provide sets of components to enable skilled art framers to assemble such displays.

A still further object of the invention is to provide optional additional incident light to illuminate framed translucent artworks mainly illuminated by back-light transmitted through the artwork.

In general, the objects of the present invention are attained in artwork displays of a translucent artwork, including shallow underlying back-lighting means and decorative overlying frame means. More particularly, the artwork display means is designed to back-light a translucent laminar artwork from a shallow underlying light-box component plus overlying laminar diffusion means completing the light-boom plus decorative frame means outlining the artwork along respective outer and/or inner edges of an optional striplike border.

Method steps include providing shallow back-lighting means with a shallow dished portion and a surrounding flanged portion, covering at least the surrounded portion with laminar light-diffusing means to complete a light-box, lighting the resulting light-box interior substantially evenly throughout; then overlying the laminar light-diffusing means with a translucent artwork, back-lighting the artwork with light from the light-box; finally outlining the artwork with decorative frame means, extending along the outer and/or inner perimeter(s) of an opaque border preferably outlining the artwork.

Other objects of this invention, together with methods and means for attaining the various objects, will become apparent from the following description and the accompanying diagrams of at least one embodiment, presented by way of example rather than limitation.

DESCRIPTION OF THE INVENTION

Figure 1:
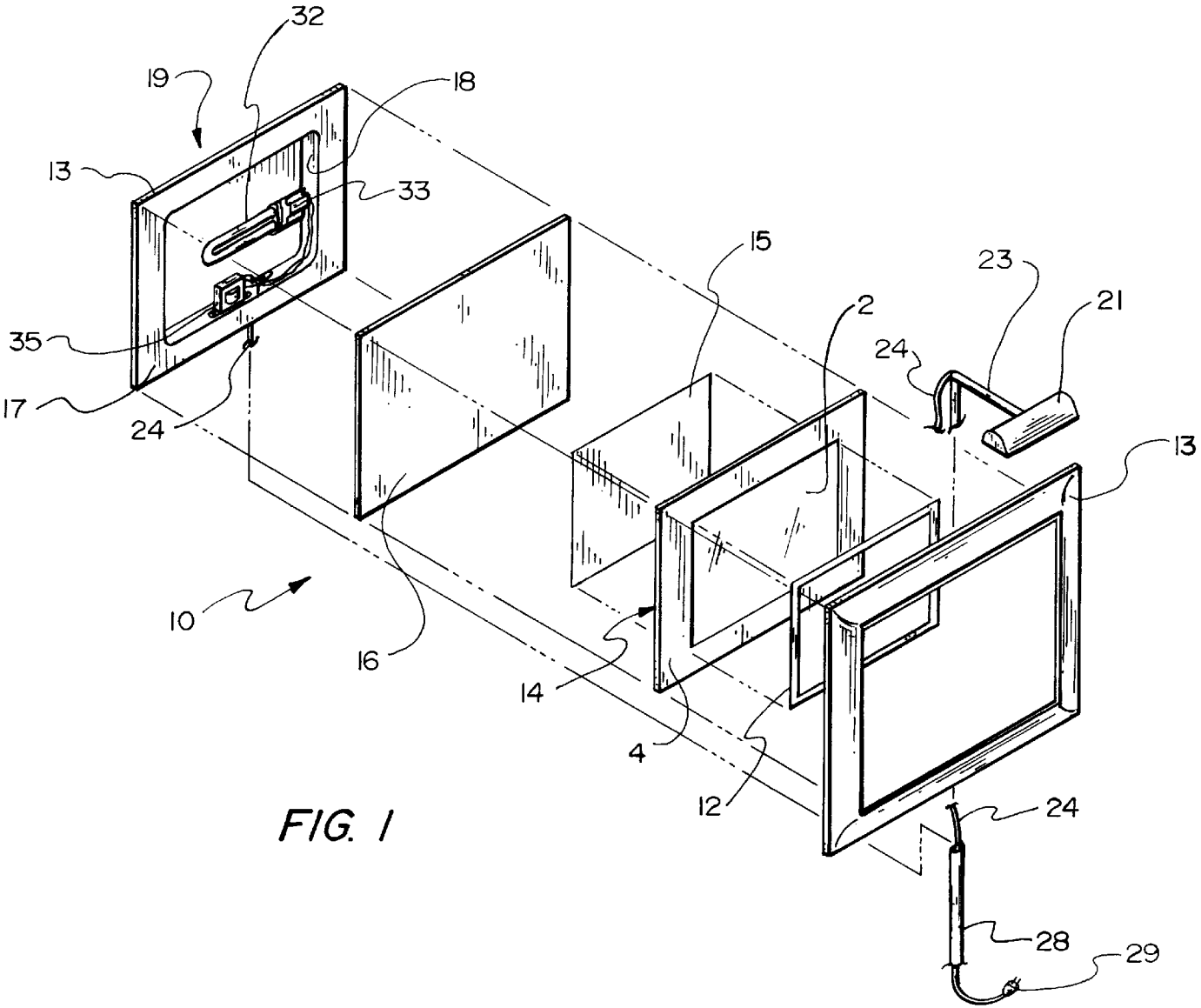
FIG. 1 is an exploded perspective of a preferred embodiment of artwork display means for laminar artworks of the present invention.

FIG. 1 shows, in exploded perspective, a substantially laminar translucent artwork 15, as it might be displayed in artwork display means 10 of this invention, featuring (front-to-back) decorative outer frame 13, smaller decorative inner frame or fillet 12 shown near laminar cover 14, whose transparent sight 2 overlies artwork 15 and whose opaque border 4 surrounds the artwork. Beyond are laminar light-diffuser 16, overlying flange 17 (and the surrounded opening) of shallow dished light-box component 19, with lamp 32 extending from base 33 affixed to one edge, and external ballast or transformer 35 on another edge of the shallow light-box component. Over-hanging the outer frame at the front is headlock reflector 21 (with hidden light bulb) on tube 23 about electrical cord 24 extending therefrom at a point of attachment to the rear edge of that frame. Below the outer frame is decorative tube 28, centered side-to-side, and covering the vertical extent of electrical cord 24, which continues to end in plug 29 for an electrical outlet (not shown).

Figure 2:
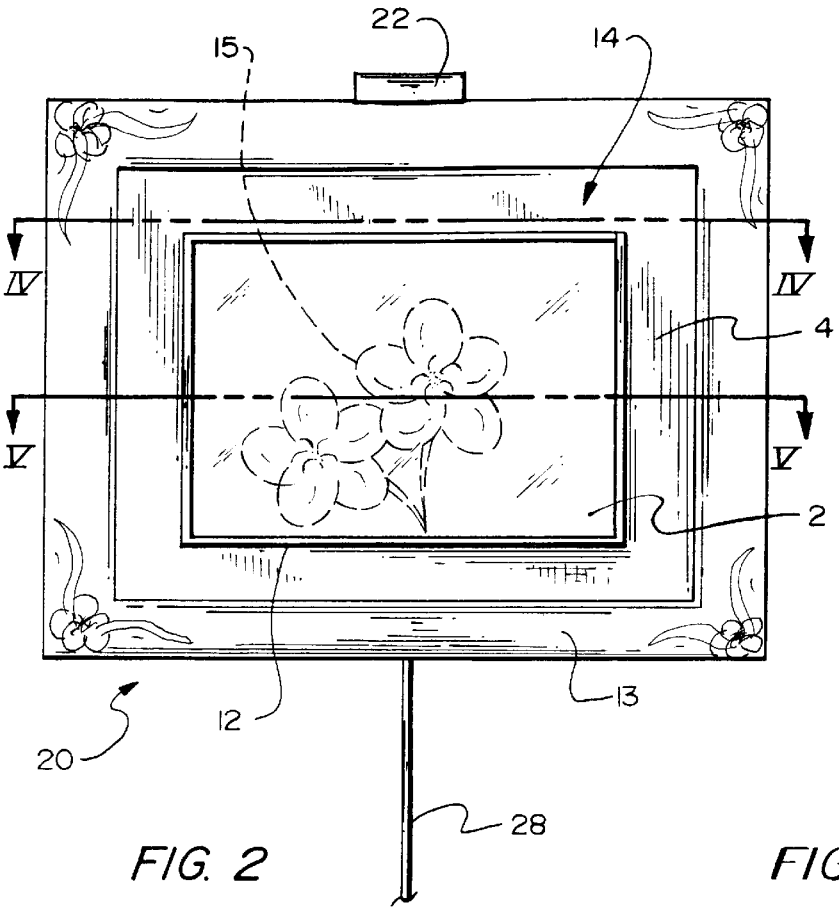
FIG. 2 is a front elevation of the same embodiment, assembled.
Figure 3:
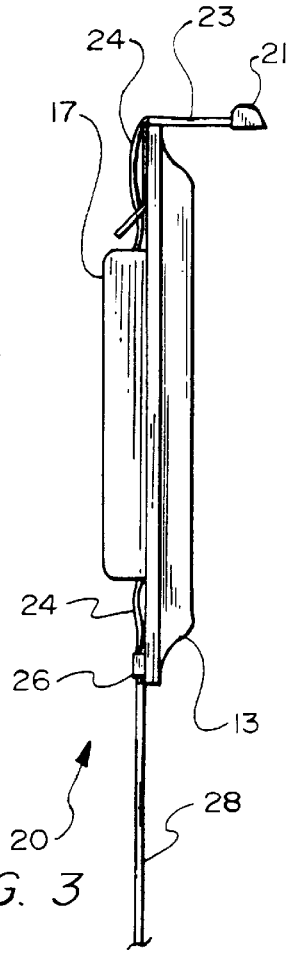
FIG. 3 is a side elevation of the same assembled embodiment.

FIGS. 2 and 3 show, in front and side elevation, respectively, assembled display 20 of foregoing display means (10) and artwork 15. In FIG. 2 the artwork appears (broken lines) through transparent sight 2 of cover 14, whose surrounding opaque border 4 is bounded by small decorative frame 12, whereas its outer peripheral edge is bounded (actually overlapped a bit) by outer decorative frame 13. External reflector 21 is supported above and ahead of the top edge of the outer frame on tube 23. The side view features a vertical edge of outer decorative frame 13, a side of dished light-box component 19, and light switch 26 behind a lower edge of the frame, as well as overhanging tube 23 and reflector 21. Cord 24 from above enters light-box component 19 and reappears below it, where it passes through switch 26 and enters decorative tube 28 to proceed vertically downward, as previously shown in further detail.

Figure 4:
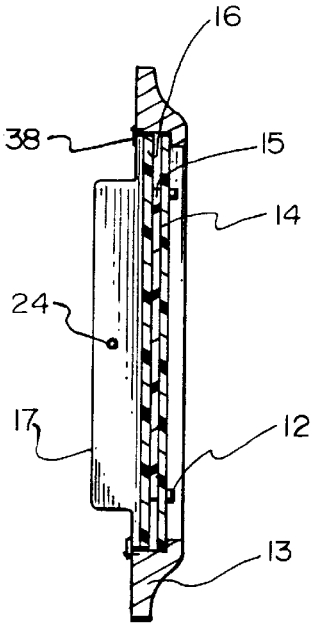
FIG. 4 is a sectional plan of the same, as at IV—IV on FIG. 3.

FIG. 4 shows in sectional plan the same display, as viewed at IV—IV on FIG. 3. Featured, left (rear) to right (front) recessed into the rebated rear face of outer decorative frame 13, are a side and flanking flange(s) 17 of light-box component 19, laminar diffuser 16, artwork 15, transparent cover 14 with opaque border on its rear face, and inner decorative frame 12 on the front of the cover.

Figure 5:
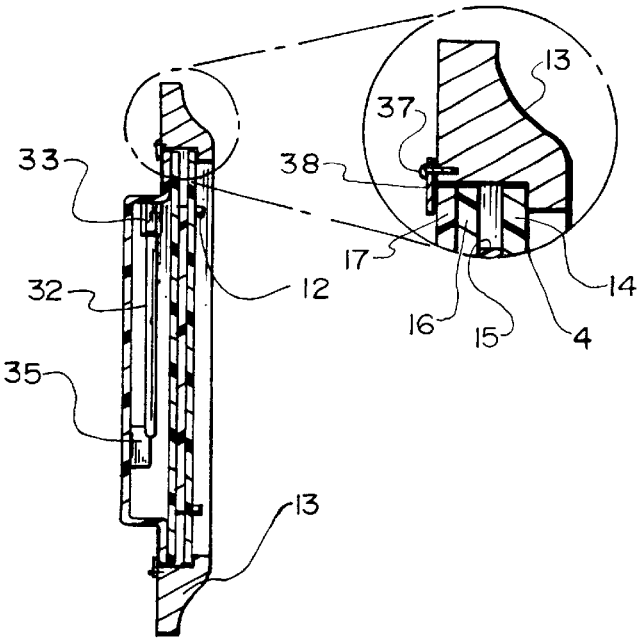
FIG. 5 is a medial sectional plan thereof, as at V—V on FIG. 3.

FIG. 5 shows display 20 in medial sectional plan, as viewed at V—V on FIG. 3. Fragmentarily visible here, in addition to most of the items in FIG. 4, are tubular light-emitting means including lamp 32 and its base 33, as well as external ballast or transformer 35. Shown in detail view (upper right) is one of a number of retaining tabs 38 overlapping a rear edge of flange 17 of the light-box and held by screw 37 in the back of the left edge of large frame 13. The tabs are adapted to pivot aside when the screws are loosened so as to dissassemble the display means and substitute another artwork. Visible from the flange forward are edges of diffuser 16, artwork 15 (minimal size) and opaque layer 4 on otherwise translucent cover 14.

Figure 6A:
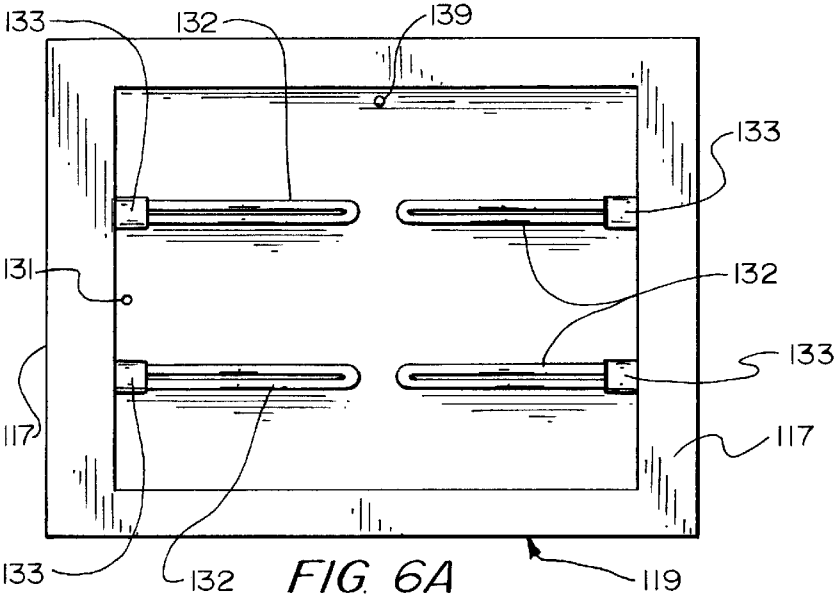
FIGS. 6A and 6B are front elevations of two versions of shallow flanged light-box component with contents thereof uncovered.
Figure 6B:
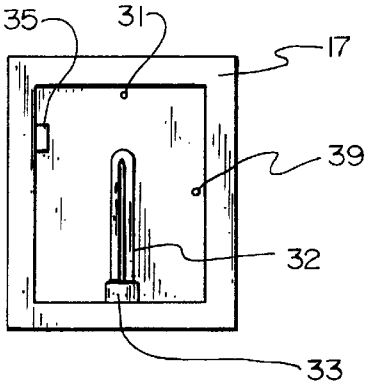

FIGS. 6A and 6B show the shallow dished light-box component in a small portrait orientation and in a larger landscape orientation, respectively. Two-digit reference numerals of FIG. 6A are prefixed by "1" to give similar three-digit reference numerals to designate corresponding features in FIG. 6B, so undue repetition is avoided.

FIG. 6A shows, in front elevation, shallow dished light-box component 19, including contents and surrounding flat flange 17 shown fragmentarily in preceding views. Openings 31 and 39 in its back are adapted to receive a protruding support for this component, so that the entire display means may be hung thereby against a wall. Opening 31 in the back is centered in the narrow dimension for use in hanging the display in portrait orientation, as here, whereas opening 39 is centered in the wide dimension for use in hanging the display in landscape orientation, shown next. Lamp 32 extends from its base 37 at one sidewall nearly to the opposite wall. External ballast or transformer 35 balances the weight of the lamp and base.

FIG. 6B shows similarly shallow dished light-box component 19' in portrait orientation. This larger display means has not just one but several lamps 132 and is to be hung in portrait orientation via a suitable support protruding, as from a wall, through opening 139.

Figure 7:
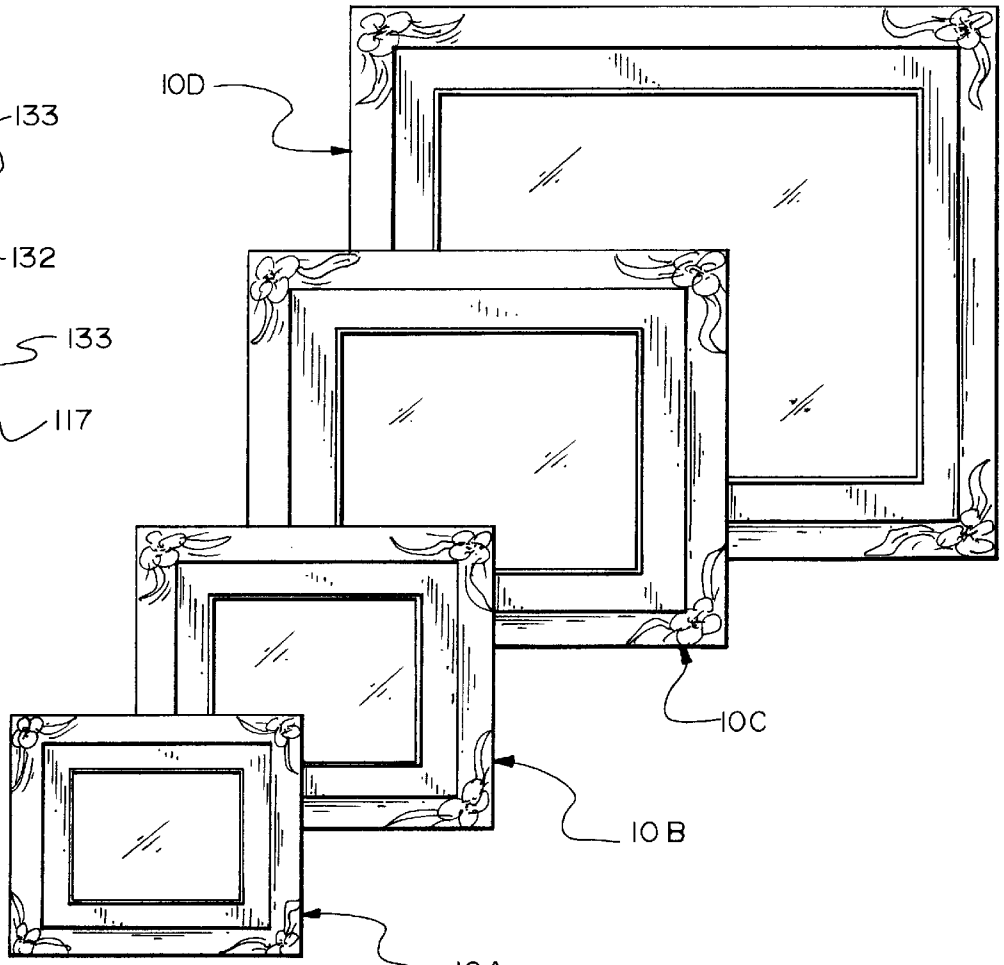
FIG. 7 is an overlapping series of front elevations of a set of various sizes of frames for the display means of this invention.

FIG. 7 is a composite perspective view of a set of various sizes of display means 10A, 10B, 10C, and 10D of this invention. It will be understood that the sizes may be conventional frame sizes, such as 5"×7", 8"×10", 11"×14", 14"×17", 16"×20" or larger, or equivalent metric sizes, as well as any non-conventional sizes.

Especially in the larger sizes, a length of picture wire may be fastened at its ends onto the frame in conventional manner and be hung on a peg extending from a wall instead of inserting a like support into an opening in the back of the light-box component.

Apparatus features of this invention have been illustrated and described, and will be readily understood, along with the methods of assembling additional artwork displays, from such illustration and description, supplemented by the following further remarks.

This invention does not require any unusual materials, and the assembly is a simple matter of mutual superimposition plus clamping of the light-box flange to the outer frame in place of conventional backing material. Adjacent laminar components may be adherent to one another, such as the divisor to the light-box flanging, and the the small decorative frame or fillet to the transparent cover.

The shallow dished light-box component with preferably integral border flange is readily fabricated by injection molding or vacuum forming of organic polymeric material, such as acrylic or vinyl thermoplastic, or by drawing of aluminum, steel, or other sheet metal. The thickness of the light-box is preferably at most about an inch and a fraction, for minimal displacement of the artwork outward from a supporting wall as is customary for conventionally framed artwork. As the light-box flanging is inset into a rabbet at the back of the frame, the overall thickness from the front of the frame to the back of the light-box preferably is only about a couple inches at most.

The light-diffusing sheet overlying the light-box opening, and underlying the artwork itself, may be frosted or milky glass or may be of suitable plastic, of length and width to cover the opening (and preferably the flange as well) of the light-box component, and of a thickness from about a millimeter to about several millimeters.

The light-emitting means preferably comprises at least one lamp of multi-lobed fluorescent type, of suitable size and wattage, so as to illuminate the interior of the light-box substantially uniformly, including an external ballast and/or transformer, if needed for lamp operation or to balance it from side-to-side, in either portrait or landscape orientation. Incandescent lamp(s) may be substituted if the attendant heat output can be tolerated. Other lighting means, such as optical fiber, could be substituted if not cost-prohibitive.

The electrical cord for connection to an external electrical outlet traverses the (optional) vertical decorative cover below the frame, and preferably the manual switch concealed behind the edge of the frame, then enters the light-box component via a suitable side opening and, after connecting to the light-emitting means, goes via side opening to the optional external light reflector and its lamp. The supporting tubing for the light reflector, like the tubing for surrounding the cord from an external electrical outlet, preferably is composed of thin gilded (or otherwise colored) plastic extrusion.

The tubing when present around the electrical cord is secured to the back edge of the large outer frame and otherwise, as may be desired, by one or more screws or equivalent fastening means. The electrical cord enters and leaves the light-box side(s) via one or more convenient openings dependent upon the placing of the contents.

The artwork itself preferably comprises one or more translucent sheets embodying artistic design(s) visible by transmitted light. The composition(s) may be glass, acrylic or vinyl (or other) organic polymer(s). Although perhaps as extensive as the outer perimeter of the light-box flanging only the artwork portion(s) within the inner perimeter of such flanging are illuminated by the back-lighting and so visible. In practice the sight presented by the artwork usually is somewhat smaller and is bordered by an opaque mat, conventionally separate paper or similar material, but here preferably coated onto the overlying transparent cover or perhaps the underlying divisor.

A photographic material useful as the base for the artwork is trademarked DURATRAN and is available from Eastman Kodak dealers throughout the world. Alternatively, the artwork may be produced on a translucent sheet by other than photographic methods, such as by drawing, painting, carving, etching, or by a combination of these or other methods, with a result observable by transmitted light.

Assembly of the display components relative to the artwork and to one another is readily apparent from the exploded view (FIG. 1).

With the light-transmitting components mounted inside the light-box component and connected to the electrical cord, the light-diffusion sheet is juxtaposed to the surrounding flange, completing the light-box. The artwork is juxtaposed to the exposed face of the diffusion sheet, and the translucent cover sheet juxtaposed to it. This multi-layered sandwiching may be accomplished successfully with or without judicious application of liquid or solid adhesive.

The optional inner frame or fillet may be secured adhesively (at any time) to the cover sheet so as to outline the artwork to be illuminated by back-lighting within the usual surrounding border.

As the outer frame is the largest component, other components may be placed within it in the appropriate order as a convenient way to assemble them, the shallow dished light-box component being last.

The resulting assembly is secured, as conventional in picture framing, as by means of fasteners spaced about the perimeter of the outer frame, usually secured pivotally thereto by screws at one end so that the other end can be swung over the edge of the rest (here the bordering flange of the light-box) and be held by tightening the screws, whereby everything is retained together as assembled.

Because the materials are readily available, and their assembly is straightforward, skilled picture framers need little or no added training or understanding to offer such artwork displays, especially with added convenience of the shallow light-box of this invention.

Advantages of the present invention include presentation of translucent artworks by transmitted light in a traditional setting, analogous to the presentation of opaque artworks by incident light. However, transmitted light enables presentation of significantly different effects from those that incident light is able to provide.

Many traditional, as well as non-traditional, photographers and other artists welcome the opportunity to reach a larger audience for their artworks, and are willing to present them in such translucent display, even if not created and presented originally in that way.

This invention also makes generally available to members of the public who take pride in portraits or scenes rendered by them in any medium, a convenient inexpensive way to display their handiwork.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention:

1. Artwork display means for translucent laminar artwork, comprising shallow back-lighting means to underlie and back-light such an artwork, an opaque border having inner and outer edges to surround the artwork, and decorative frame means including a decorative frame along the entire perimeter of at least one of the edges of the opaque border.

2. Artwork display, comprising artwork display means according to claim 1, plus translucent laminar artwork so bordered.

3. Artwork display means according to claim 1, including in the decorative frame means a decorative frame along the entire perimeter of the inner edge of the opaque border and a larger decorative frame along the entire perimeter of the inner edge of the opaque border.

4. Artwork display, comprising artwork display means according to claim 3, plus a translucent laminar artwork so bordered.

5. Artwork display, comprising opaque backing means including a flat flanged peripheral border portion surrounding and joined to a shallow dished portion thereof, laminar light-diffusing means closely overlying the backing means border and thus defining a light box including the dished portion, internal lighting means adapted to light the interior of the light box substantially evenly throughout, translucent artwork covering the laminar light-diffusing means overlying the dished portion of the resulting light box in position to be illuminated by transmitted light therefrom, and decorative frame means about the artwork and spaced circumferentially apart from it by the border portion.

6. Artwork display according to claim 5, wherein the lighting means includes at least one light-emitting element.

7. Artwork display according to claim 5, including an external electrical cable and decorative tubular means covering the electrical cable extending downward from and being visible below the framed artwork display.

8. Artwork display according to claim 7, wherein the tubular means is oriented vertically below the center of the bottom edge of the frame means.

9. Artwork display according to claim 5, including frame-supported external lighting means spaced above and adapted to illuminate the frame and the nearby surroundings of the display means by incident light.

10. Display method for artwork, comprising the steps of back-lighting a laminar location for translucent artwork, diffusing light reaching that back-lighted location, locating a laminar translucent artwork at that location, locating an opaque border having an inner edge surrounding the artwork location and having an outer edge about its inner edge, and outlining the artwork by locating decorative frame means along substantially the entire outer peripheral edge of the opaque border, and by locating additional decorative inner frame or fillet means along substantially the entire inner peripheral edge of the border.

11. Artwork display method according to claim 10, including the steps of covering the artwork with laminar transparent means, and locating the border on the laminar transparent means.

12. Artwork displayed supported parallel to a wall according to the method of claim 11.

13. Artwork display means adapted to display a back-lighted translucent laminar artwork substantially parallel, and nearly as close, to a wall as front-lighted artwork is customarily displayed, comprising an outer frame having a given depth, adapted to outline and to support translucent laminar artwork substantially parallel to a wall, back-lighting means adapted to be assembled to the frame and including backing means having a portion dished to a similar depth and adapted to contain lighting means for back-lighting such an artwork, laminar diffuser means adapted to cover the dished portion of the backing means and to underlie the laminar artwork, and transparent laminar means adapted to overlie and protect the laminar artwork.

14. Artwork display means according to claim 13, wherein the backing means dished portion has a flat peripheral flange around it adapted to underlie the diffuser means and be closed off thereby.

15. Artwork display means according to claim 13, wherein the given depth is about an inch, and the overall depth of the display means is at most about a couple inches.

* * * * *